US006745591B1

(12) United States Patent
Lin

(10) Patent No.: US 6,745,591 B1
(45) Date of Patent: Jun. 8, 2004

(54) COOLING-LUBRICANT REPLENISHING ACCESSORY FOR A COMPRESSOR

(76) Inventor: Shan-Chi Lin, No. 7, Lane 457, Chungcheng Rd., Hsinchuang City, Taipei Hsien (TW)

( * ) Notice: Subject to any disclaimer, the term of this patent is extended or adjusted under 35 U.S.C. 154(b) by 0 days.

(21) Appl. No.: 10/453,298

(22) Filed: Jun. 3, 2003

(51) Int. Cl.[7] ..... F25B 45/00
(52) U.S. Cl. ..... 62/292; 62/468
(58) Field of Search ..... 62/292, 149, 468, 62/505

(56) References Cited

U.S. PATENT DOCUMENTS 4,338,793 A * 7/1982 O'Hern, Jr. ..... 62/292
6,439,274 B1 * 8/2002 DeBoisblanc ..... 141/67

FOREIGN PATENT DOCUMENTS

DE 1993-248448 * 3/1993

* cited by examiner

*Primary Examiner*—Melvin Jones
(74) *Attorney, Agent, or Firm*—Alan D. Kamrath; Nikolai & Mersereau, P.A.

(57) ABSTRACT

A cooling lubricant replenishing device for a compressor has an adapter, a flexible tube, a three-way tube, a pressure gauge, and a check valve. The adapter is adapted to selectively mount on a refrigerant inlet of the compressor and communicate with three-way tube via the flexible tube. The three-way tube has three ends respectively connected with the flexible tube, the pressure gauge, and the check valve. The check valve adapts to further connect with an extruder containing cooling lubricant, the extruder provides a pushing force to make the cooling lubricant pass through the tubes and enter the compressor. Whereby, the compressor is conveniently replenished with the cooling lubricant by using the extruder in a convenient way.

4 Claims, 4 Drawing Sheets

COOLING-LUBRICANT REPLENISHING ACCESSORY FOR A COMPRESSOR

BACKGROUND OF THE INVENTION

1. Field of the Invention

The present invention relates to a cooling lubricant replenishing accessory, and more particularly to a cooling lubricant replenishing accessory that conveniently replenishes cooling lubricant into a compressor.

2. Description of Related Art

Compressors are widely used in vehicles, air conditioners, refrigerators, and other similar cooling devices to compress and transport refrigerant into a heat exchanger system. The compressors have various configurations and usually operate under a high-pressure circumstance. Therefore, each compressor of different types has a hermetic casing to encase essential elements of the compressor inside. In addition to electrical wires connecting to a power supply and a transporting tube for refrigerant connecting to the heat exchanger extending from the casing to outside of the compressor, a refrigerant filling inlet is secured on the casing to selectively communicate with an interior of the compressor for measuring pressure inside the compressor and for filling the compressor with the refrigerant.

However, no matter what kind of compressor it is, all compressors are composed of a complex structure and need lubricant to be fed into the compressor to keep the elements moving smoothly and to avoid frictional wear of the elements. The lubricant is exhausted after the compressor has operated for a period of time, and the compressor needs to be then recharged with lubricant to maintain the trouble-free operation of the elements. If the compressor needs to be replenished with the lubricant, the refrigerant is drained out first to decrease the pressure of the compressor and then the casing must be disassembled to add the lubricant because the compressor is hermetically sealed. Finally, the casing is refitted to the body of the compressor. Therefore, replenishing the lubricant into the compressor is troublesome and causes high repair costs to the compressor. For this sake, a user of the compressor usually skips the replenishing operation of the compressor such that the compressor operates with insufficient lubrication and prematurely wears out. When the compressor malfunctions, the compressor has to be disassembled for repair and the compressor is only then recharged with lubricant by making use of this opportunity of the disassembled compressor. Moreover, the compressor is sometimes even abandoned in favor of the purchase of a new one as the repair cost may be close to the cost of a new compressor.

The present invention has arisen to mitigate or obviate the disadvantages of the conventional compressor.

SUMMARY OF THE INVENTION

The main objective of the present invention is to provide a cooling lubricant replenishing accessory for a compressor to enable the compressor to be replenished with the cooling lubricant in a convenient way.

Further benefits and advantages of the present invention will become apparent after a careful reading of the detailed description with appropriate reference to the accompanying drawings.

DETAILED DESCRIPTION OF THE PREFERRED EMBODIMENT

A cooling lubricant replenishing device for a compressor in accordance with the present invention comprises an adapter, a flexible tube, a three-way tube, a pressure gauge, and a check valve. The cooling lubricant used in the present invention is a well-known lubricant containing both effects of refrigerant and lubricant and is mostly used to substitute the refrigerant in a compressor.

The adapter is adapted to selectively mount on a refrigerant inlet of a compressor and communicate with three-way tube via the flexible tube. The three-way tube has-three ends respectively connected with the flexible tube, the pressure gauge, and the check valve. The check valve is adapted to further connect with an extruder containing cooling lubricant, the extruder provides a pushing force to make the cooling lubricant pass through the tubes and enter the compressor.

Figure 1:
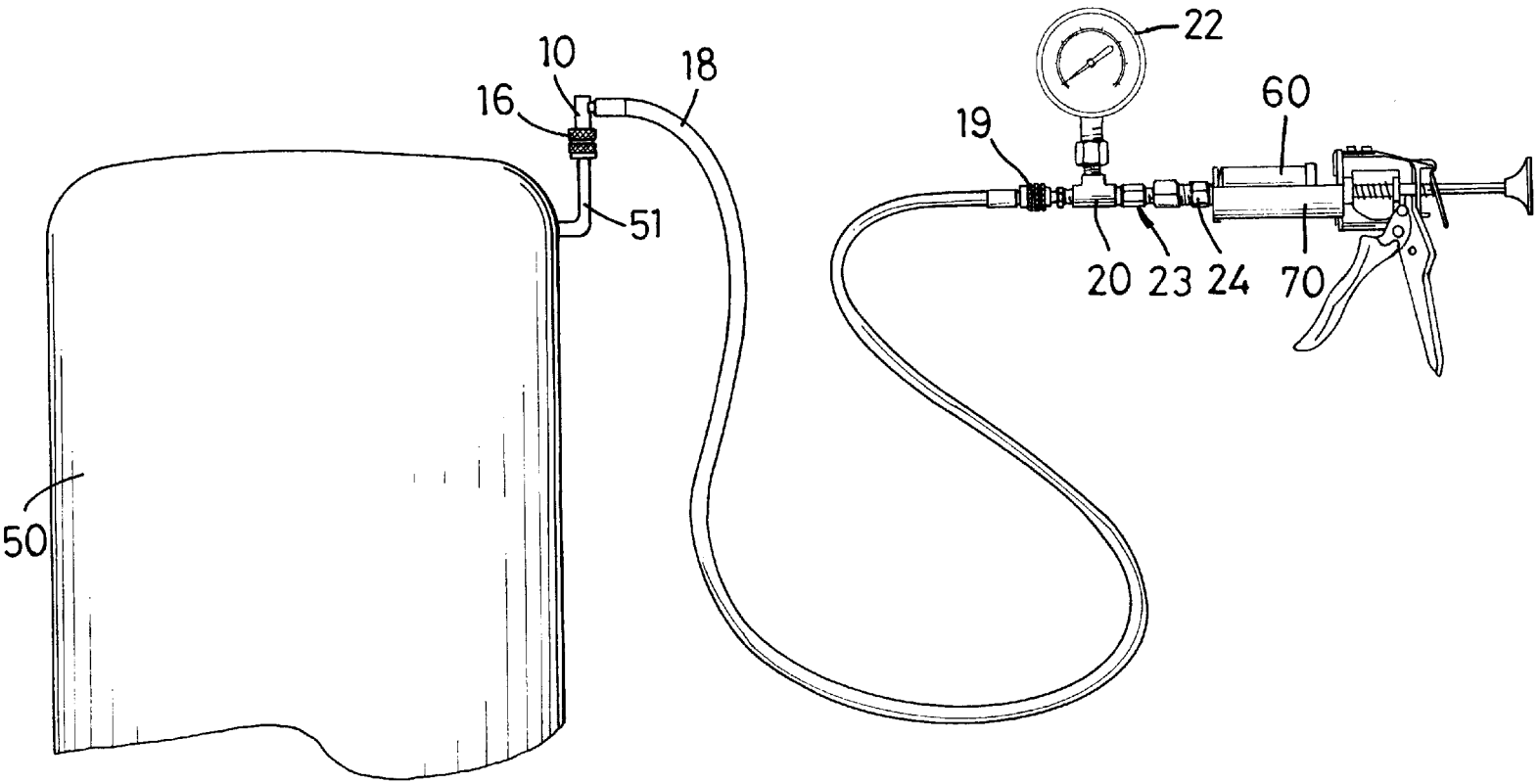
FIG. 1 is a side plane view of a cooling lubricant replenishing accessory for a compressor in accordance with the present invention, wherein the cooling lubricant replenishing accessory adapts to connect with a compressor.
Figure 2:
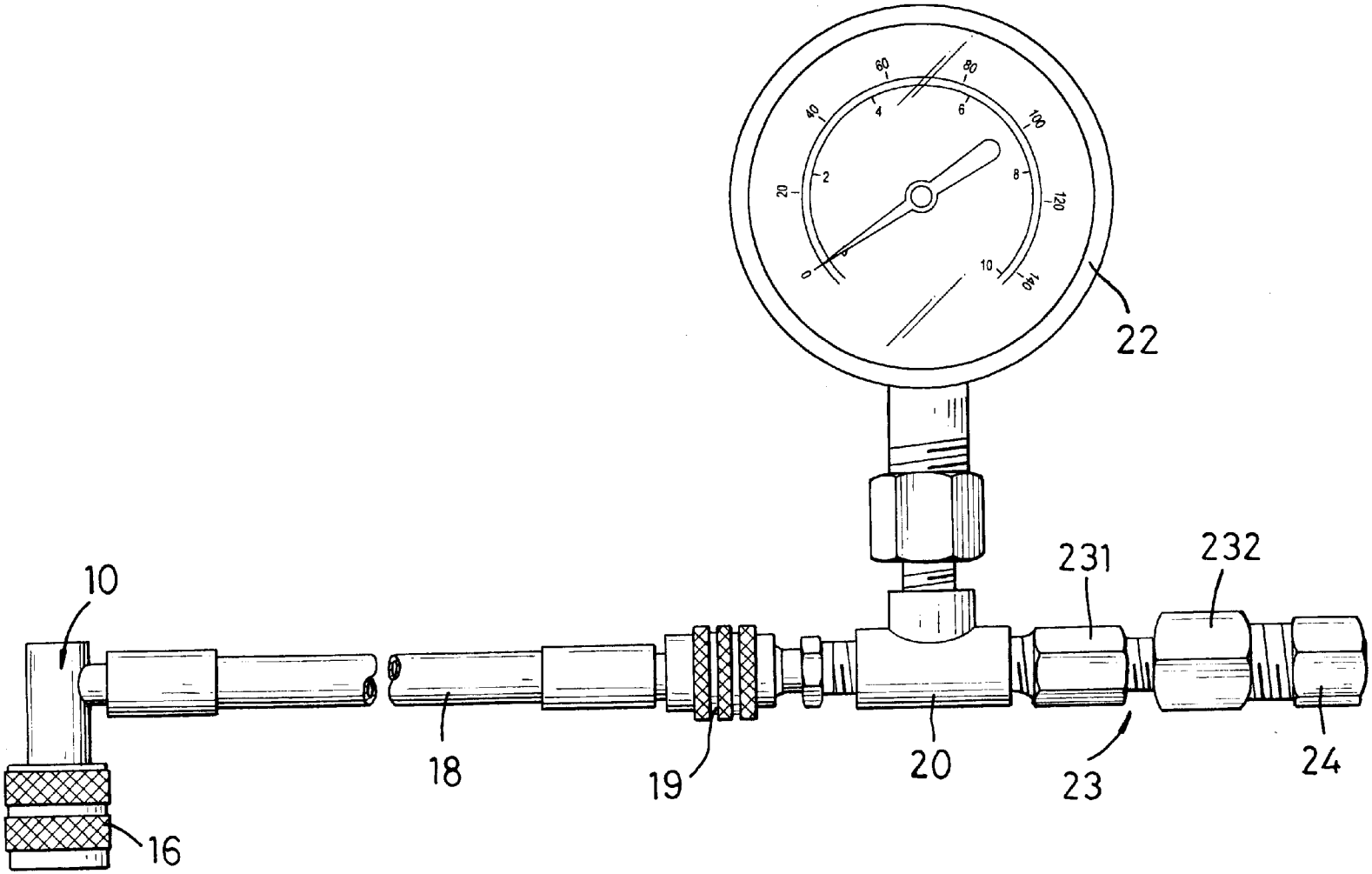
FIG. 2 is a partially enlarged side plane view of the cooling lubricant replenishing accessory in FIG. 1, which shows a three-way tube combined between a check valve and a flexible tube.
Figure 3:
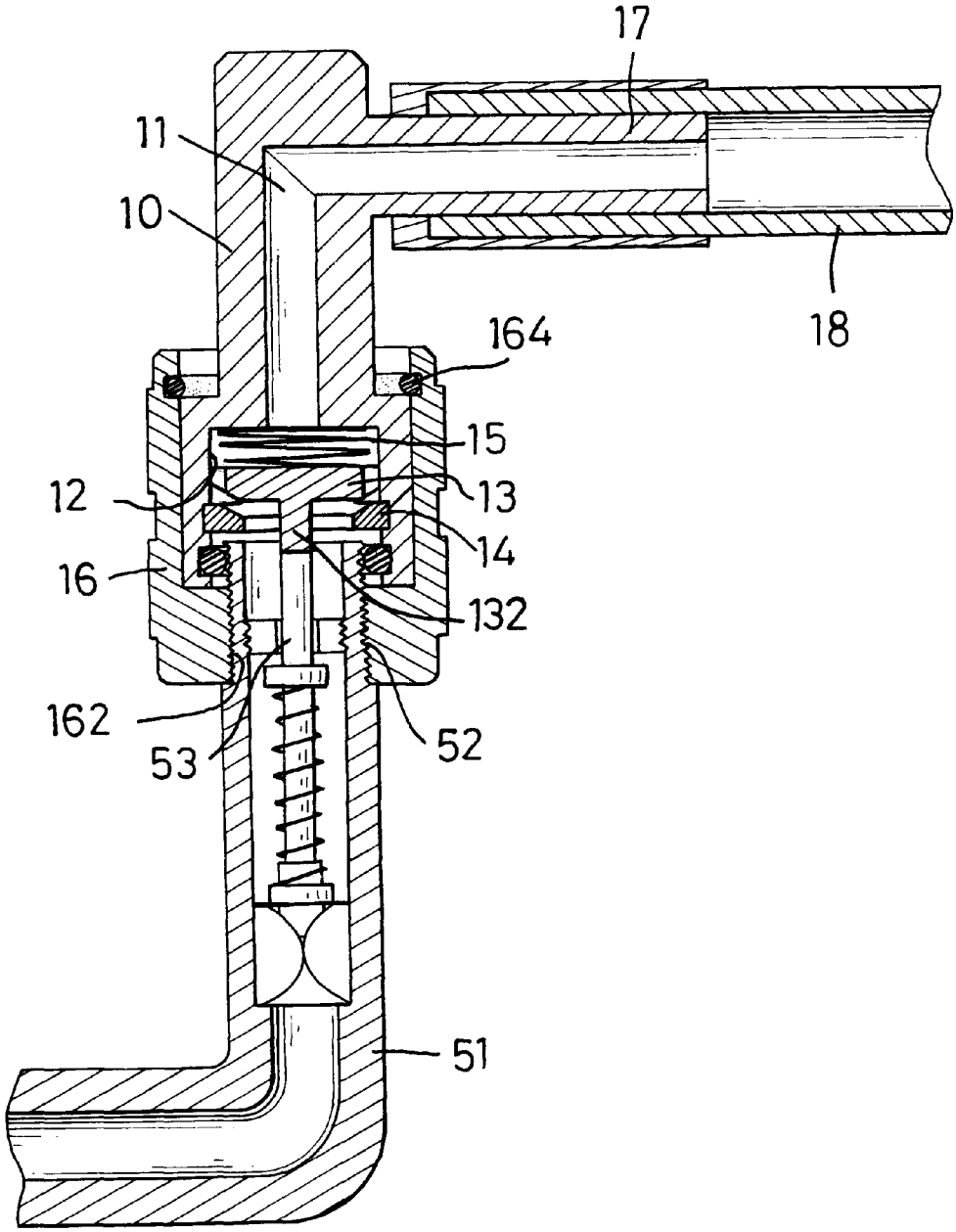
FIG. 3 is a partially enlarged and cross-section -side plane view of the cooling lubricant replenishing accessory in FIG. 1, which shows a junction between a refrigerant inlet and an adapter.

With reference to FIGS. 1, 2 and 3, a preferred embodiment of a cooling lubricant replenishing accessory for a compressor (50) in accordance with the present invention comprises an adapter (10), a flexible tube (18), optionally a connector (19), a three-way tube (20), a pressure gauge (22), and a check valve (23).

The adapter (10) is a tube that has a detachable end (not numbered), a stationary end (17) perpendicular to the detachable end, a connecting device (not numbered) mounted on the detachable end, and a channel (11) is defined through the adapter (10) from the detachable end to the stationary end (17). The detachable end adapts to selectively mount on a refrigerant inlet (51) via the connecting device and has an enlarged portion (not numbered) and a recess (12) with a bottom defined in the enlarged portion to communicate with the channel (11). The connecting device is composed of a socket (16) and a C-clasp (164). The socket (16) rotatably surrounds the enlarged portion by means of the C-clasp (164) between the enlarged portion and the socket (16) and has a threaded opening (162) defined toward the refrigerant inlet (51) and adapted to engage with a threaded distal end (52) of the refrigerant inlet (51). Optionally, the detachable end further comprises a piston (13), a stop cushion (14) and a spring (15). The spring (15) is accommodated inside the recess (12) and abuts the bottom of the recess (12). The piston (13) mounts on the spring (15) inside the recess (12) and selectively abuts with the stop cushion (14) attached on an inner periphery of the recess (12) to close the channel (11). The piston (13) further has a post (132) protruding from the piston (13) and toward the refrigerant inlet (51) to adapt to abut with a valve-shaft (53) inside the refrigerant inlet (51). Whereby, the piston (13) adapts to be pushed by the valve-shaft (53) to separate from the stop cushion (14) to open the channel (11) when the socket (16) receives and engages the refrigerant inlet (51).

The flexible tube (18) is made of plastic or rubber material and has two ends; one end is firmly secured on the stationary end (17) of the adapter (10) and the other end is firmly secured with the three-way tube (20). Optionally, a connector (19) is secured between the flexible tube (18) and the three-way tube (20) to enable convenient detachment of the replenishing accessory.

Figure 4:
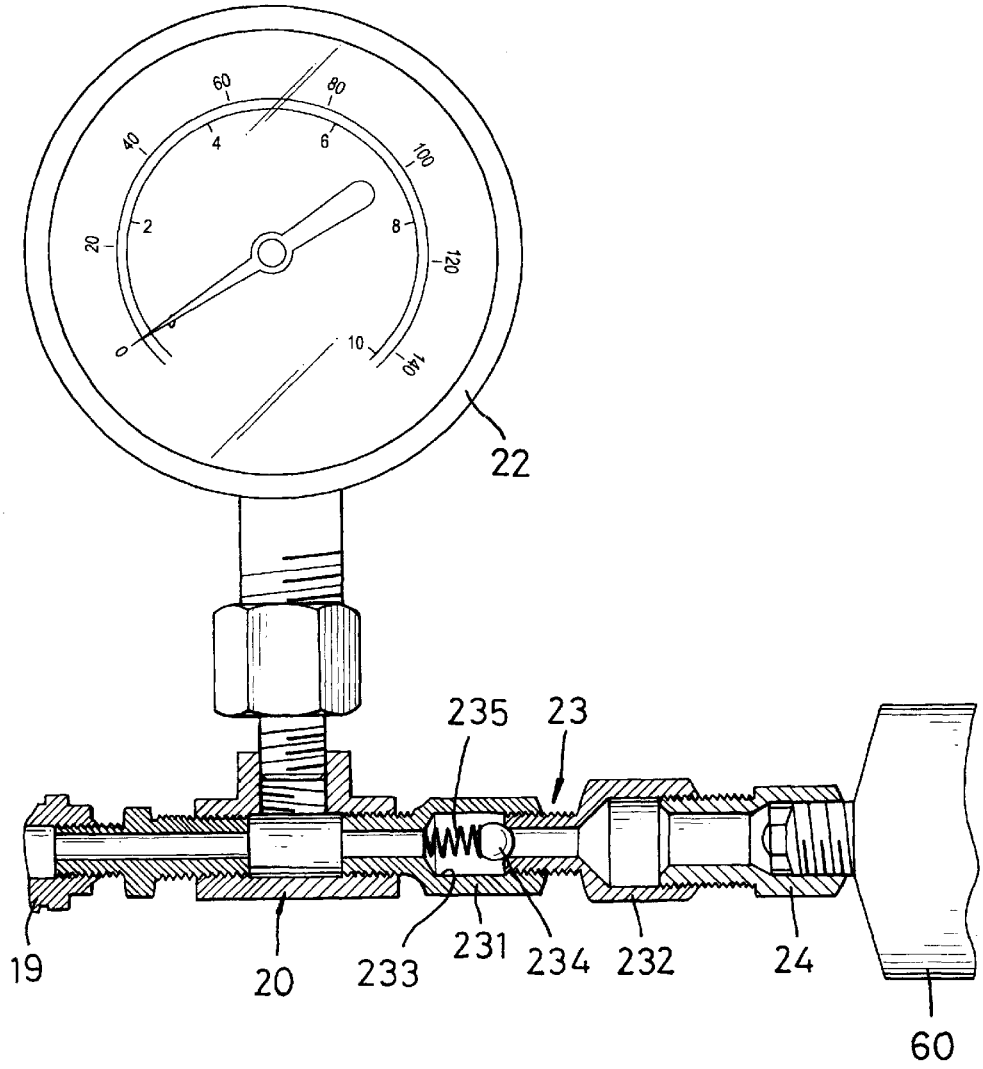
FIG. 4 is a partially enlarged and cross-section side plane view of the cooling lubricant replenishing accessory in FIG. 2, which shows junctions between the three-way tube, the check valve, and a grease gun.

Referring to FIGS. 2 and 4, the three-way tube (20) has a first end, a second end, and a third end respectively engaged with the connector (19), the pressure gauge (22) and the check valve (23). The pressure gauge (22) adapts to measure the pressure of the compressor (50) to ensure the compressor (50) is safe in a normal pressure range to replenish the cooling lubricant. The check valve (23) is composed of a first connecting tube (231) and a second connecting tube (232) engaging with each other. The first connecting tube (231) has a narrow end (not numbered) engaging with the third end of the three-way tube (20) and an enlarged end (not numbered) engaging with the second connecting tube (232) to construct a chamber (233) defined in the enlarged end of the first connecting tube (231). A coil spring (235) with a ball (234) is accommodated inside the chamber (233) to push the ball (234) to block the second connecting tube (232). Whereby, the check valve (23) is achieved and the cooling lubricant can not reflow from the first connecting tube (231) to the second connecting tube (232). The second connecting tube (232) also has a narrow end (not numbered) engaging with the enlarged end of the first connecting tube (231) and has an enlarged end (not numbered) adapted to engage with a refrigerant-charged extruder such as a grease gun (60), as shown in FIG. 1. Optionally, a fitting third connecting tube (24) is secured between the second connecting tube (232) and a port (not numbered) of the grease gun (60) in case of that the port is not matched with the enlarged end of the second connecting tube (232).

When the cooling lubricant replenishing accessory is used, the adapter (10) mounts on the refrigerant inlet (51) to allow the channel (11) to communicate with the compressor (50). Then, the grease gun (60) is operated to push the cooling lubricant through the check valve (23), the three-way tube (20), the flexible tube (18) and the adapter (10) to enter the compressor (50). Therefore, the compressor (50) is replenished with cooling lubricant in a convenient way without disassembling the casing of the compressor (50) such that the compressor (50) has sufficient cooling lubricant to operate smoothly. Although the invention has been explained in relation to its preferred embodiment, many other possible modifications and variations can be made without departing from the spirit and scope of the invention as hereinafter claimed.

What is claimed is:

1. A cooling lubricant replenishing accessory for a compressor with a refrigerant inlet, the replenishing accessory comprising:

an adapter adapted to mount on the refrigerant inlet of the compressor to communicate with the compressor;

a flexible tube with two ends, and one of the ends communicating with the adapter;

a three-way tube having a first end, a second end, and a third end, the three-way tube connecting with the other end of the flexible tube at the first end of the three-way tube;

a pressure gauge connecting with the second end of the three-way tube; and a check valve connecting with the third end of the three-way tube and adapted to connect with an extruder to push cooling lubricant into the compressor.

2. The cooling lubricant replenishing accessory as claimed in claim 1, wherein the adapter comprises a detachable end, a stationary end connected with the flexible tube, a connecting device mounted on the detachable end of the adapter, and a channel defined through the adapter from the detachable end to the stationary end;

wherein the detachable end has an enlarged portion and a recess with a bottom defined in the enlarged portion to communicate with the channel;

wherein the connecting device comprises:

a socket rotatably surrounding the enlarged portion and having a threaded opening defined in the socket and adapted to engage the refrigerant inlet; and a C-clasp secured between the enlarged portion and the socket to rotatably mount the socket on the enlarged portion of the detachable end.

3. The cooling lubricant replenishing accessory as claimed in claim 2, wherein the detachable end further comprises:

a spring accommodated inside the recess and abutting the bottom of the recess;

a stop cushion attached on an inner periphery of the recess; and a piston mounted on the spring inside the recess and abutting with the stop cushion to selectively close the channel;

wherein the piston adapts to be pushed by a valve-shaft of the refrigerant inlet to selectively open the channel.

4. The cooling lubricant replenishing accessory as claimed in claim 1, wherein the check valve comprising:

a first connecting tube having a narrow end engaging with the third end of the three-way tube and an enlarged end engaging with the second connecting tube to construct a chamber defined in the enlarged end of the first connecting tube;

a coil spring with a ball accommodated inside the chamber to push the ball to selectively block the second connecting tube; and the second connecting tube has a narrow end engaging with the enlarged end of the first connecting tube and has an enlarged end adapted to engage with the extruder.

* * * * *